US007955243B2

(12) United States Patent
Hu

(10) Patent No.: US 7,955,243 B2
(45) Date of Patent: Jun. 7, 2011

(54) POSTER PRINTING USING PERFORATED PAPER

(75) Inventor: Hao Hu, Belmont, CA (US)

(73) Assignee: Konica Minolta Systems Laboratory, Inc., San Mateo, CA (US)

( * ) Notice: Subject to any disclaimer, the term of this patent is extended or adjusted under 35 U.S.C. 154(b) by 302 days.

(21) Appl. No.: 11/540,108

(22) Filed: Sep. 28, 2006

(65) Prior Publication Data

US 2008/0141885 A1 Jun. 19, 2008

(51) Int. Cl.
*B31B 1/14* (2006.01)

(52) U.S. Cl. ..... 493/343; 156/258; 156/264; 156/263

(58) Field of Classification Search ..... 156/63, 156/258, 263, 299; 493/343
See application file for complete search history.

(56) References Cited

U.S. PATENT DOCUMENTS

| | | | | |
|---|---|---|---|---|
| 6,004,421 | A * | 12/1999 | Landa | 156/258 |
| 2002/0118374 | A1* | 8/2002 | Wanko | 358/1.2 |
| 2003/0025920 | A1* | 2/2003 | Yamamoto | 358/1.2 |
| 2003/0044200 | A1* | 3/2003 | Connors | 399/182 |
| 2004/0013455 | A1* | 1/2004 | Matsuyama | 400/76 |
| 2004/0080784 | A1* | 4/2004 | Fujimoto | 358/1.15 |
| 2004/0085587 | A1* | 5/2004 | Broddin et al. | 358/3.06 |
| 2005/0062778 | A1* | 3/2005 | Tanaka et al. | 347/15 |
| 2005/0244603 | A1* | 11/2005 | Hodsdon et al. | 428/40.1 |
| 2009/0137184 | A1* | 5/2009 | Schreff et al. | 446/120 |

* cited by examiner

*Primary Examiner* — Daniel J Colilla
*Assistant Examiner* — David Banh
(74) *Attorney, Agent, or Firm* — Chen Yoshimura LLP

(57) ABSTRACT

A poster printing method divides a large format poster image into a plurality of image sections and prints them on individual sheets of paper, where some or all of the sheets are perforated sheets with perforation lines along the edges. Unavoidable white margins on the printed sheets can be removed by tearing off strips of the sheet along the perforation lines. The distance of the perforated lines from the edge is determined by a minimum white margin value and a maximum image shift error value for a typical small printer. In addition, the image sections are overprinted, i.e., the image printed on each individual sheet contains an overprinted area around the image section to ensure image overlap of neighboring sheets. The individual sheets are assembled into a poster by removing the perforated portions of some sheets and aligning images on neighboring sheets along the perforation lines.

5 Claims, 4 Drawing Sheets

POSTER PRINTING USING PERFORATED PAPER

BACKGROUND OF THE INVENTION

1. Field of the Invention

This invention relates to printing of large format printouts (poster printing), and in particular, it relates to poster printing using small printers.

2. Description of the Related Art

Poster printing refers to large format printing where the printouts have sizes many times larger than a letter or A4 sized sheet. For example, a poster may be 36 inches by 24 inches in size. In addition, high quality printouts are desired for poster printing. Conventionally, posters are printed on large format papers and require sophisticated, large printers to print. Small printers, i.e., printers typically used in homes or business offices, are typically limited to letter, legal, A4 and A3 sizes papers and cannot handle larger sized papers. To enable printing of a large format poster using a small printer in an inexpensive manner, some printer drivers or application software provide a poster printing function, which divides the large poster image into smaller image sections, typically rectangular in shape, as shown in FIG. 1. In the example shown in FIG. 1, a 36 inch by 24 inch poster is divided into 3 by 3 image sections to be printed. The image sections are printed separately on individual sheets of paper, and assembled together by the user to form a large format poster.

SUMMARY OF THE INVENTION

One problem with the above poster printing method is that each printed sheet has a white margin (border) that must be precisely trimmed, and the sheets must be precisely positioned and assembled together to form a high quality poster. A white margin on a printed sheet is unavoidable, because the printer needs to hold the paper border to transport the sheet during printing. FIG. 2 illustrates a printed sheet 21 for a center portion of the poster 20. The printed sheet 21 has a white margin 21*a*, which must be trimmed as illustrated by the dashed lines 21*b*. The trimmed sheet 21 then must be positioned in the appropriate location as indicated at 20*c* to align precisely with the neighboring sheets, so that the trimmed border lines 21*b* align with the trimmed border lines of the neighboring sheets as indicated by the dashed lines 20*b*. These steps are tedious and time consuming, especially for larger posters such as those made up of 4 by 4 or 5 by 5 sheets, and a small error can easily ruin the whole poster.

Accordingly, the present invention provides a method for poster printing using small printers that substantially obviates one or more of the problems due to limitations and disadvantages of the related art.

An object of the present invention is to provide an easier method for producing a poster using a small printer.

Another object of the present invention is to improve the quality of the assembled poster.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a method for producing a large format printout of an image, and an apparatus carrying out the method. For instance, one typical method reflecting one aspect of the present invention includes: dividing the image into a plurality of image sections; defining a plurality of printed image areas each containing an image section and an overprinted image area around the image section; and printing each of the plurality of printed image areas on a sheet of medium (e.g. paper), wherein at least some of the sheets of medium are perforated sheets containing one or more perforation lines along one or more corresponding edges of the medium. The method further comprises assembling the printed sheets into a poster, including removing portions of at least some sheets along one or more perforation lines and aligning images on neighboring sheets along the perforation lines. Preferably, the perforation lines are located at a distance of at least A+B from the corresponding edge of the medium, where A is a width of minimum white margin and B is an amount of maximum image shift error, the values of A and B being pre-determined. Preferably, the overprinted image area has a width C which is equal to or greater than B.

In another aspect, the present invention provides a method for producing a large format printout of an image, including: (a) providing a plurality of perforated sheets of medium, each perforated sheet containing one or more perforation lines each located at a distance P of at least $A_0+B_0$ from a corresponding edge of the sheet, where $A_0$ is a width of minimum white margin and $B_0$ is an amount of maximum image shift error, the values of $A_0$ and $B_0$ being pre-determined; (b) obtaining a width A of unprinted area on each sheet, an amount of overprinting C, and a paper size S; (c) calculating a size of image sections from the values A, C and S; (d) dividing the image into a plurality of image sections each having the calculated size or a fraction thereof; (e) defining a plurality of printed image areas each containing an image section and an overprinted image area of width C around the image section; and (f) printing each of at least some of the plurality of printed image areas on perforated sheets of medium.

In another aspect, the present invention provides a computer program product comprising a computer usable medium having a computer readable program code embedded therein for controlling a data processing apparatus, the computer readable program code configured to cause the data processing apparatus to execute a process for producing a large format printout of an image at least partially using perforated sheets of medium that contain one or more perforation lines located along one or more corresponding edges of the medium, the process comprising: (a) obtaining a value $A_0$ representing a width of minimum white margin, a value $B_0$ representing a an amount of maximum image shift error, a value P representing a distance because the perforation lines and the corresponding edges of the sheets of medium, and a paper size S; (b) determining a value A representing a width of unprinted margins and a value C representing an amount of overprinting, which satisfy the conditions $A \geqq A_0$, $C \geqq B_0$, and $A+C \geqq P$; (c) calculating a size of image sections from the values A, C and S; (d) dividing the image into a plurality of image sections each having the calculated size or a fraction thereof; (e) defining a plurality of printed image areas each containing an image section and an overprinted image area of width C around the image section; and (f) printing each of at least some of the plurality of printed image areas on perforated sheets of medium.

It is to be understood that both the foregoing general description and the following detailed description are exemplary and explanatory and are intended to provide further explanation of the invention as claimed.

DETAILED DESCRIPTION OF THE PREFERRED EMBODIMENTS

An improved poster printing method according to embodiments of the present invention uses perforated paper to print the individual sheets, and applies an overprinting method to print each sheet. The methods may be implemented by software as a part of a printer driver or a part of an application program that handles images. The invention is directed to both the method and an apparatus, such as a printer or computer, which implements the method by executing a program stored in a non-volatile memory, such as a read only memory (ROM). The method may be introduced into the apparatus by updating the firmware in the non-volatile memory. In this regard, the method may be brought to the apparatus in a form of a package of install software and the firmware, which may be divided and/or compressed so that the install software effectively install the firmware. The package may be steadily stored in a computer readable diskette, such as a compact disk, or may be transmitted through a wire/wireless communication line.

Overprinting refers to dividing a large poster image into image sections to be printed on individual sheets, and printing an enlarged image area on each sheet that includes both an image section and an additional strip portion of the image abutting each side of the image section. In this disclosure, "image sections" refer to sections of the poster image as a result of dividing the image, which collectively make up the poster image and do not overlap each other. An "image section border" refers to a border between two image sections, i.e., the lines that divide the poster image into image sections. A "printed image area" refers to an area of the image printed on an individual sheet, which includes both an image section and an overprinted image area around the image section. (The overprinted image area can be considered to have a width of zero when the image is not overprinted.)

Figure 1:
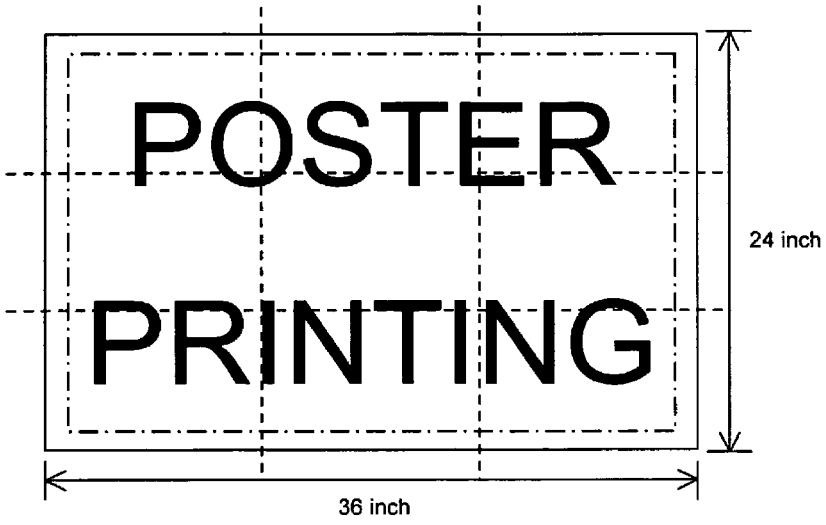
FIG. 1 illustrates a poster formed by multiple individual printed sheets.
Figure 2:
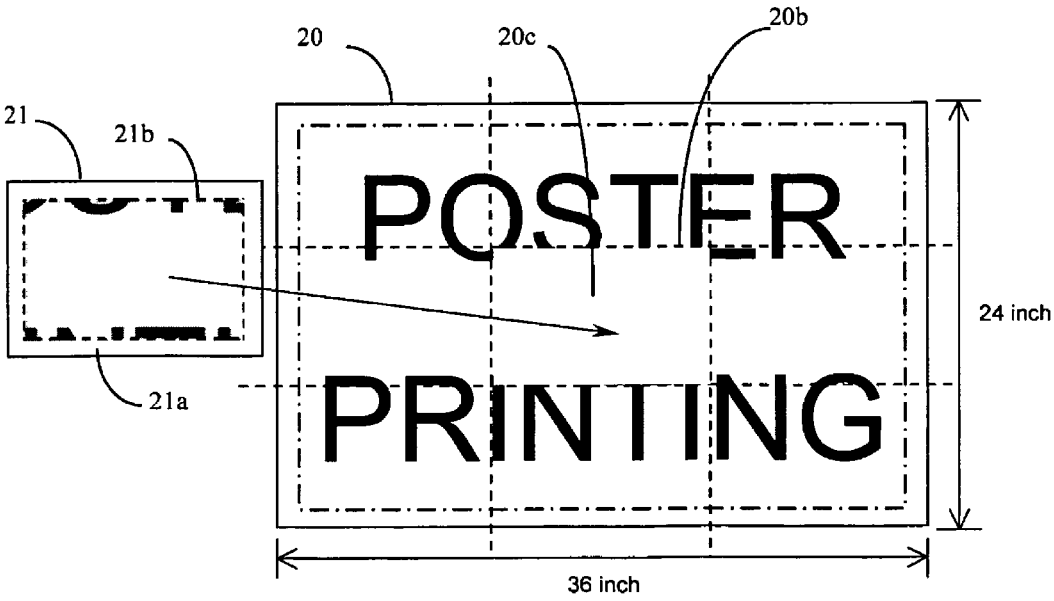
FIG. 2 illustrates a conventional poster printing and assembling method.
Figure 3:
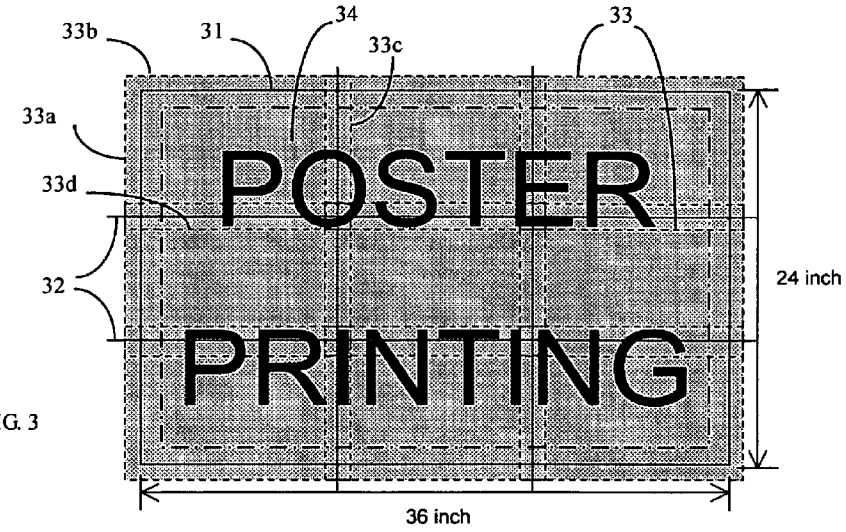
FIG. 3 illustrates overprinting of individual printed sheets making up a poster according to an embodiment of the present invention.

FIG. 3 illustrates overprinting. In FIG. 3, the solid frame lines 31 indicate the border of assembled poster, and the solid dividing lines 32 indicate the image section borders. The dashed lines 33 indicate the borders of the printed, untrimmed sheets. For example, dashed lines 33*a-d* indicate an untrimmed sheet 34 located in the upper left-hand corner of the poster. On each printed sheet, there will be a white margin due to the printer's need to hold the paper during transport, but each sheet is overprinted so that the image section borders are contained within the printed area on each sheet. When assembling the poster, either one or both of a pair of adjoining sheets are trimmed to remove the white margin as well as a thin strip of the overprinted area, and the trimmed sheet is overlaid onto the other sheet so that the images align precisely. So long as sufficient overprinted portions are present (more detail is described later), it will always be possible to precisely align the images on the two sheets.

Another feature of the poster printing method according to embodiments of the present invention is the use of perforated paper. Since the individual sheets making up a poster always have unprintable white margins, trimming is a step that cannot be avoided. If regular paper is used, the sheets must be cut to remove portions that contain the white margins. According to an aspect of the present invention, perforated paper is used to print the individual sheets. The perforations are provided at a distance from the edges of the paper that is greater than the minimum white margin of a typical printer. Thus, in lieu of cutting, the individual printed sheets can be trimmed to remove the white margins by tearing at the perforations. (Note that it is sufficient to remove the perforated strip for only one of the two neighboring sheets because the white margin of the other sheet will be covered and not visible. It is of course permissible to remove the perforated strips of both neighboring sheets.)

One advantage of using perforated paper is that, because the trim lines are pre-defined relative to the edges of the paper, the software can determine how the poster image is divided and the amount of overprinting so that the image section borders are aligned with the perforation lines. Another advantage is that tearing along perforated lines is easier than cutting and does not require any special tools, whereas precisely cutting a sheet of paper often requires a large paper cutter which may not always be available to a user.

Figure 4:
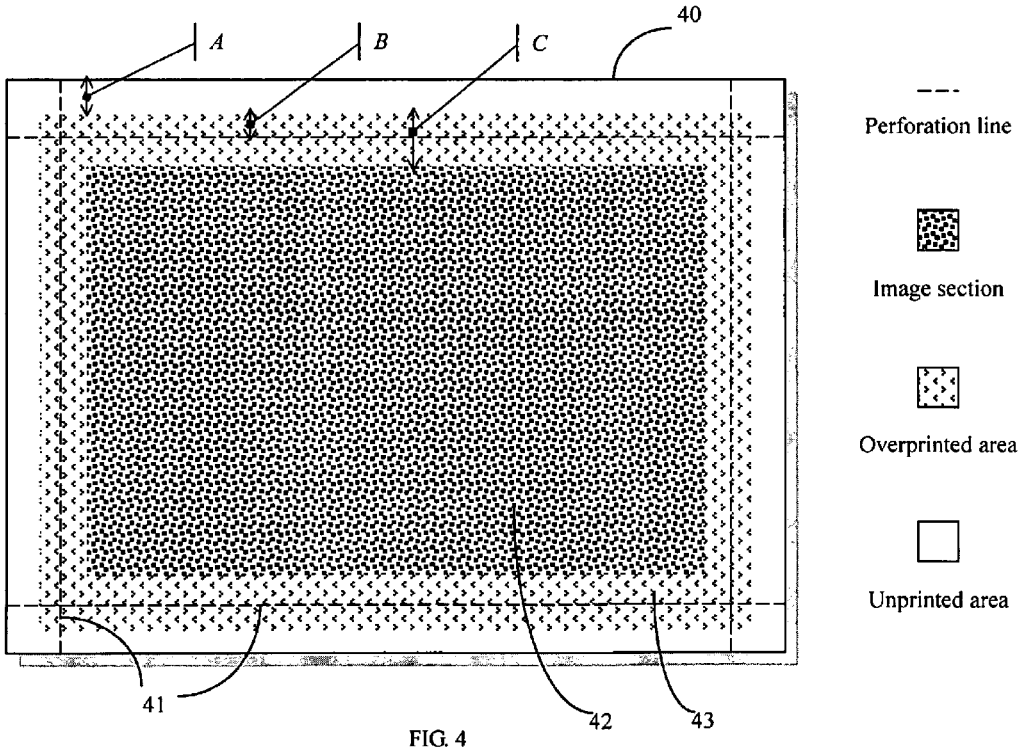
FIG. 4 illustrates the setting of the perforation and the amount of overprinting according to an embodiment of the present invention.

The width of the minimum white margin of the printer is a main factor that determines the amount of overprinting as well as the perforation setting of the paper. Another consideration is that, to make the assembling easier, the images on any pair of two neighboring sheets should overlap after the perforated strips are removed for one or both of the sheets. The setting of the perforation lines and the amount of overprinting is explained with reference to FIG. 4. FIG. 4 shows a sheet of paper 40 provided with perforation lines 41 along the edges. The width A denotes the width of the unprinted area on the sheet. The value A is set by the poster printing software (described in more detail later), and may be any value greater than or equal to the minimum white margin $A_0$ for the printer, i.e., the margin the printer needs to transport the paper correctly. For typical small printers, the minimum white margin is approximately 0.2 inches. The minimum white margin of the printer will decide the maximum printable area on the sheet. The width B denotes the distance between the outer boundary of the printed image area (which is outside the perforation lines) and the perforation lines 41. The value B is set by the poster printing software (described in more detail later), and may be any value greater than or equal to the image shift error $B_0$ of the printer. Image shift error reflects the error or tolerant in the accuracy of paper transportation mechanism of the printer. The shift can occur in any direction., i.e., the image can shift in any direction by a maximum amount of $B_0$. For typical small printers, the image shift error $B_0$ is approximately 0.08 inches. The requirement of $B \geqq B_0$ means that the printed image area is larger than the area of the paper within the perforation lines by at least a width of $B_0$ on all sides. This ensures that the printed area will completely cover the paper area within the perforated lines even with maximum image shift errors. The relationship between A, B, and the distance P between the perforation lines 41 and the edge of the paper (referred to as the perforation setting) is $P=A+B$.

Note that on a printed sheet, the white margins on the four sides may be different from the value A due to image shift. In this regard, the values A and B should be understood to be the intended values even though on a printed sheet the actual boundary of the image may be shifted.

The width C in FIG. 4 denotes an amount of image overprinting. The printed image area of the sheet includes an image section (the central area 42), and an overprinted image portion 43 forming a band of width C around the image section 42. The overprinting amount C is selected to ensure that, even at the maximum of image shift error, when one of the two neighboring sheets is trimmed at the perforation line, there will still be certain image overlap on the two neighboring sheets to allow the two sheets to be correctly aligned and assembled. This requires the value of C to be greater than the value of B. In other words, the size of the image section is equal to or smaller than the size of the paper area within the perforation lines (even though the image section is not always contained within the perforation lines due to image shift error). So long as this requirement is met, any suitable value for C may be used. For example, the value C in the width or height direction of the paper may be chosen as $C=B+c_1*S$, where S is the width or height of the paper, respectively (the paper size), and the parameter c, is a fractional value. In one particular example, C=B+5%*S. Alternatively, C may be chosen as $C=B+c_2$, where $c_2$ is a constant.

In the above-described example, the widths A and B are assumed to be equal in the lengthwise and widthwise directions of the paper. These values may be different in the two directions, and the perforation setting P and the overprinting amount C may be different in the two directions as well. In the latter case, each of the values A, B, C, P as well as S should be understood to contain two parts, one for the lengthwise direction and one for the widthwise directions of the paper, although they are simply referred to as "the value A", etc. in this disclosure.

Figure 5:
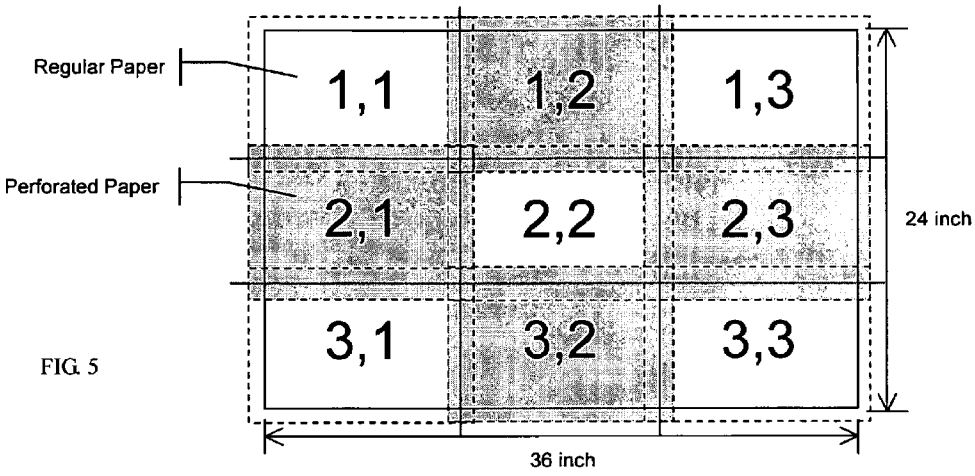
FIG. 5 illustrates an example of paper selection for a poster according to an embodiment of the present invention.

Not all individual sheets making up a poster need to be printed on perforated paper. Perforated paper is likely more expensive than regular (i.e. non-perforated) paper. Since each sheet contains an overprinted image area and the individual printed sheets will overlap each other when assembled, regular paper can be used for some sheets, and the white margin need not be removed because it will be covered by the neighboring sheets. The general is that two neighboring sheets should not both be non-perforated sheets. In one preferred embodiment, non-perforated and perforated sheets are used alternately so that they form a checkerboard pattern. In other words, in each column and each row of sheets, the sheets alternate between non-perforated paper and perforated paper. Of course, any of the non-perforated sheets may be substituted with a perforated sheet. FIG. 5 illustrates paper selection for an example of a 3×3 poster. The sheets are labeled with a column index i (i=1 to N) and a row index j (j=1 to N) as (i, j). Perforated paper is used for all sheets that satisfy $i+j=2k+1$, k=1, 2, 3, 4, . . . (i.e. the sum of i and j is an odd number). Regular paper is used for all other sheets. Thus, in this example, sheets (1,1), (1,3), (2,2), (3,1), and (3,3) may use non-perforated paper, and sheets (1,2), (2,1), (2,3), and (3,2) will use perforated paper. This paper selection method works well when the poster image itself has a white border, as the sheets located on the edge of the poster will not need to be trimmed at the outer edge. If the poster image itself does not have a white border, then the sheets located at the edge of the poster should use perforated paper.

When both regular paper and perforated paper are used, the printer driver will select the appropriate paper for each sheet. When the printer has more than one paper tray, perforated paper and regular paper can be put in different trays and the printer will selectively use the appropriate paper to print each sheet. For printers that have only one paper tray, the printer may separate all image sections into two groups, those that will be printed on regular paper and those that will be printed on perforated paper, and print them separately. Before each group is sent to the printer, the software will prompt the user to put correct paper in the tray.

In the above description, it is assumed that the perforated paper is perforated on all four sides. It is possible to use papers that are perforated on some but not all sides. For example, sheet (1,2) in the example in FIG. 5 can use paper that is perforated on three sides. In practice, however, using such papers tends to complicate paper selection, as it likely requires the operator to manually supply many kinds of perforated papers, making the process prong to operator error.

In operation (refer to FIG. 6), perforated paper is provided to the printer (step S61), where the perforation setting P has been pre-determined (e.g. by the manufacturer). For the perforated paper to work properly on a particular printer, the perforation setting P should be greater than the value $A_0+B_0$ for that printer. Since it is desirable for the perforated paper to be useful on most small printers, P should be set to be greater than a typical value $A_0+B_0$ for most small printers. In practice, other factors such as ease of handling may also influence the choice of the perforation setting P. For example, while the value $A_0+B_0$ for a typical small printer may be approximately 0.28 inches, a perforated strip of 0.28 inches may be difficult to handle when tearing it off. Thus, it may be more desirable to set the perforation setting at a larger value, such as 0.5 inches. Regardless of how P is determined, it is taken as a given value for the poster printing software.

Figure 6:
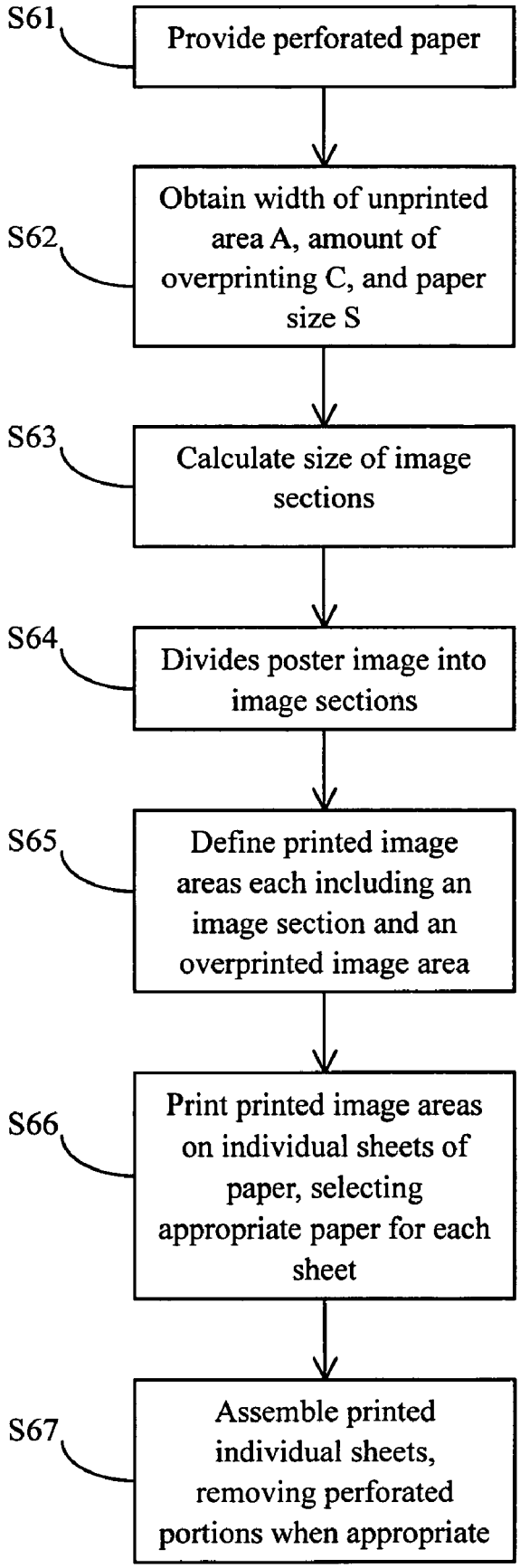
FIG. 6 is a flow chart illustrating a method according to an embodiment of the present invention.

When the software receives a command to print a poster, it obtains the paper size S and the perforation setting P. The values $A_0$ and $B_0$, either the actual minimum white margin and image shift error values for the particular printer or typical values of minimum white margin and image shift error for small printers, are also obtained by the software. The software then sets the values A (width of the unprinted white margins) and B (distance from the outer boundaries of the printed area to the perforation lines) subject to the following constraints or conditions: $A \geqq A_0$, $B \geqq B_0$, and $A+B=P$. The software also calculates the overprinting amount C based on the value B and a pre-determined relationship, for example, $C=B+c_1*S$ or $C=B+c_2$ as described earlier, or any other relationship so long as $C \geqq B$. For the purpose of calculating the image to be printed on each sheet (see steps S63 to S65 below), only the values S (paper size), A (width of unprinted margin), and C (overprinting amount) need to be known to the software. Those skilled in the art will recognize that because the values P, A, B, and C are interrelated and are subject to certain constraints, the values A and C needed by the software may be arrived at in a number of ways. In the method described above, the software takes the values P, $A_0$ and $B_0$ as given, and determines the values A and C subject to the constraints $A \geqq A_0$, $C \geqq B_0$, and $A+C \geqq P$. This is a more automated approach because the values that are provided to the software (P, $A_0$ and $B_0$) are hardware factors and the software determines the rest while ensuring that the various constraints are satisfied. Other approaches are of course possible. One example is to directly provide the values A and C to the software, either as user input or as values pre-programmed into the software. If this approach is used, the user or the programmer needs to make sure that the various constraints imposed by hardware factors are met (e.g., $A \geqq A_0$, $C \geqq B_0$, and $A+C \geqq P$). Therefore, more generally, step S62 in FIG. 6 is a step of obtaining the values A, C and S, and may be implemented in a number of ways as discussed above.

Based on the values of A and C and the paper size S, the software calculates the size (width and height) of the image sections that will fit on individual sheets (step S63). This is done by subtracting the values of 2*A and 2*C from the paper width and height. The software then divides the poster image into a plurality of image sections based on the size of the image sections (step S64), and define the plurality of printed image areas each of which including a corresponding image section and an overprinted image area of width C (step S65). Steps S64 and S65 can be combined into one step in actual implementation. Each printed image area is then printed on an individual sheet of paper (step S66), taking into consideration whether regular paper or perforated paper should be used for each sheet using principles described earlier. Note that for the last row and last column of sheets, the printer image areas may be smaller than would be allowed by the paper. In such a case, the image should be printed to one side of the paper (e.g. to the right-hand side if the last column is the right-hand column) so that the non-printed area of the paper can be covered by the neighboring sheets. Lastly, the user assembles the printed individual sheets, removing perforated portions of the sheets as appropriate (step S67).

Apparent from the above, the sequence from step S62 through step S66 is carried out in the apparatus and steps S61 and S67 involve human interaction. Therefore, software in the apparatus may contain a computer readable program that carries out steps S62 through S66.

Additional features may be provided in the poster printing function of the printer driver or application program. For example, the software may allow the user to selectively print individual sheets of a poster. This is convenient for the user because in the printing and assembling process of a poster, sometimes one or more individual sheets may be destroyed due to user error. It will be wasteful to re-print all sheets of the entire poster. Thus, the software provides user an option to only print sheets that contain selected image sections with appropriate overprinting portions. A user interface such as a poster print preview can be presented to allow the user to easily select the image sections to be re-printed.

Figure 7:
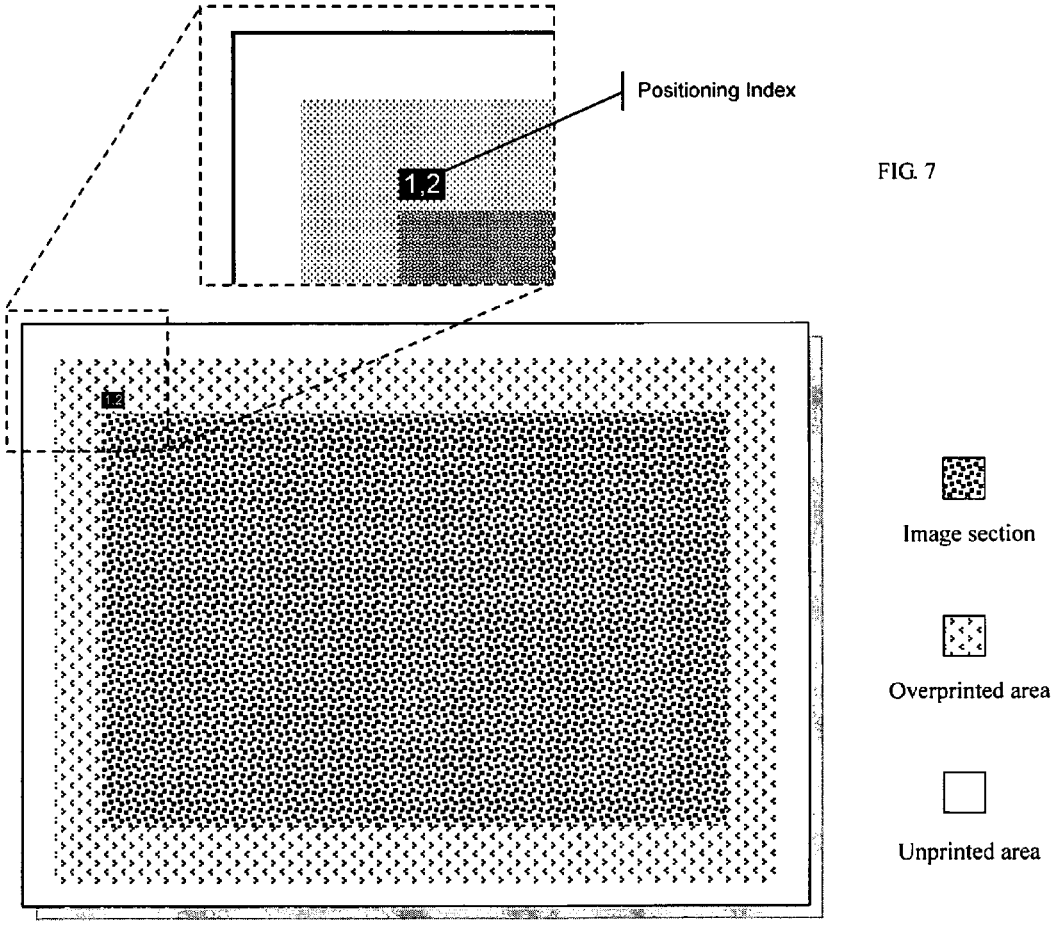
FIG. 7 illustrates a printed positioning index on a sheet according to an embodiment of the present invention.

Another additional feature is to provide a printed positioning index on each sheet to assist in the assembling process. Sometimes it may be difficult for the user to determine which printed sheet should be placed at which position when assembling the poster. A small positioning index, such as a pair of column and row numbers, may be printed in the overprinted area of each sheet, such as near a corner, to help the user identify the sheet during assembly. The position index should be printed in an area outside of a perforation line that will either be torn off or in an area that will be covered by a neighboring sheet. Even in the case where a perforation paper is used, the latter may be preferable because the user can recognize the positioning index of the paper even after he/she tears off the perforation from the paper. In the example shown in FIG. 7, the positioning index is printed near the top-left corner within the overprinted area. Referring to the operation explained in connection with FIG. 6, the positioning indices can be added to each printed image areas in step S56.

The method described above can be used to print on paper or other suitable printing medium such as thin plastic sheets, etc.

It will be apparent to those skilled in the art that various modification and variations can be made in the poster printing method of the present invention without departing from the spirit or scope of the invention. Thus, it is intended that the present invention cover modifications and variations that come within the scope of the appended claims and their equivalents.

What is claimed is:

1. A method for producing a large format printout of an image, comprising:

dividing the image into a plurality of image sections, each image section having a rectangular shape;

defining a plurality of printing image areas each containing one of said plurality of image sections and an overprinted image area around said one image section; and printing each of the plurality of printing image areas on a respective sheet of medium, wherein at least some of the sheets of medium are perforated sheets containing one or more perforation lines along one or more corresponding edges of the medium, wherein a size of the image section on each sheet of medium is smaller than and falls within an area of the sheet defined by the perforation lines and any edges that do not have a corresponding perforation line, wherein each perforated sheet contains four perforation lines along four edges of the sheet, and wherein some of the printing image areas are printed on perforated sheets and others of the printing image areas are printed on non-perforated sheets, and wherein the perforated sheets and non-perforated sheets form a checkerboard pattern when assembled into the large format printout of the image.

2. The method of claim 1, further comprising assembling the printed sheets into a the large format printout of the image, the assembling step including removing portions of at least some sheets along one or more perforation lines and aligning images on neighboring sheets along the perforation lines.

3. The method of claim 1, where each perforation line on each respective sheet of medium is located at a distance of at least $A_0+B_0$ from the corresponding edge of said respective sheet of medium, where $A_0$ is a width of minimum white margin and $B_0$ is an amount of maximum image shift error, the values of $A_0$ and $B_0$ being pre-determined.

4. The method of claim 1, wherein all of the printing image areas are printed on perforated sheets.

5. The method of claim 1, further comprising printing a positioning index on each sheet of medium.

* * * * *